US008485281B2

(12) United States Patent
Siepi

(10) Patent No.: US 8,485,281 B2
(45) Date of Patent: Jul. 16, 2013

(54) EQUIPMENT FOR DRILLING SECANT HOLES

(75) Inventor: Maurizio Siepi, Cesena (IT)

(73) Assignee: Soilmec S.p.A., Casena (FC) (IT)

( * ) Notice: Subject to any disclaimer, the term of this patent is extended or adjusted under 35 U.S.C. 154(b) by 131 days.

(21) Appl. No.: 12/812,894

(22) PCT Filed: Jan. 13, 2009

(86) PCT No.: PCT/EP2009/000145
§ 371 (c)(1),
(2), (4) Date: Feb. 3, 2011

(87) PCT Pub. No.: WO2009/090034
PCT Pub. Date: Jul. 23, 2009

(65) Prior Publication Data

US 2011/0120779 A1 May 26, 2011

(30) Foreign Application Priority Data

Jan. 14, 2008 (IT) ..... TO2008A0025

(51) Int. Cl.
*E21B 17/10* (2006.01)
*E21B 7/08* (2006.01)

(52) U.S. Cl.
USPC ..... 175/73; 175/81; 175/230; 175/326

(58) Field of Classification Search
USPC ..... 175/73, 76, 81, 230, 326; 405/267, 405/233
See application file for complete search history.

(56) References Cited

U.S. PATENT DOCUMENTS

| | | | | |
|---|---|---|---|---|
| RE20,131 | E * | 10/1936 | Reilly | 384/31 |
| 4,432,422 | A * | 2/1984 | Hopley et al. | 175/61 |
| 2007/0105405 | A1 * | 5/2007 | Biserna et al. | 439/45 |

FOREIGN PATENT DOCUMENTS

| | | |
|---|---|---|
| EP | 0 580 264 | 1/1994 |
| EP | 1 770 219 | 4/2007 |

* cited by examiner

*Primary Examiner* — Brad Harcourt
(74) *Attorney, Agent, or Firm* — Merchant & Gould P.C.

(57) ABSTRACT

Equipment for drilling secant holes (2) includes by an excavating system (3, 14, 4, 16, and 17) and by a guide system (7, 8), both of which are set in the hole (2) being drilled and in a previously made hole (2'). The two systems are fixed with respect to one another in such a way as to define a pre-set distance between centers of the holes; the excavating system includes a motor (3) and a bit (4) connected thereto, and being completely introduced into the borehole.

26 Claims, 1 Drawing Sheet

EQUIPMENT FOR DRILLING SECANT HOLES

This application is a National Stage Application of PCT/EP2009/000145, filed 13 Jan. 2009, which claims benefit of Serial No. TO 2008 A 000025, filed 14 Jan. 2008 in Italy and which applications are incorporated herein by reference. To the extent appropriate, a claim of priority is made to each of the above disclosed applications.

BACKGROUND

The present invention relates to equipment for drilling secant holes.

SUMMARY

Described in the European patent application published under No. EP-1,770,219 are a method and equipment for making arrays of secant holes, the distance between centres of which is guaranteed by a guide system, which slides in the hole previously made connected to the drilling equipment operating in the next hole with the required distance between centres.

Experience has shown the possibility of a series of problems in execution and of alternatives in the operations, and the solution to the problems forms the subject of the present invention.

It should be noted that the diameter of the guide, which is smaller than that of the hole, enables minor movements of the excavating system that can lead to a path that deviates with respect to the axis of the previous hole. This play, in a rigid structure, is necessary to prevent any jamming both in the step of digging and in the step of extraction.

In addition, the solution of a traditional type adopted up to now, with a motor for turning the drilling bit external to the excavation and with drill rods that can be jointed together, entails times for assembly and disassembly of these rods that are decidedly long. This is particularly penalizing in the case of emergency maintenance operations to be performed on the drilling bit, which involve extraction thereof from the borehole. In these cases, all the rods are to be dismantled and put back together again.

In addition, the increasing weight of the drill string increasingly weighs upon the excavating members, whereas optimal performance of the latter is obtained at a constant load. Consequently, the current solution envisages a force of thrust upon, or withholding of, the string that is to be dosed gradually and carefully on the basis of the variable weight of the string itself.

Drilling in rock, concrete, or hard or irregular soil causes vibrations and fracturing of the material to be dug, with consequent formation of coarse flakes, that are difficult to clear out by the mud-flush system. Said flakes are liable to cave into the hole made previously and hinder descent of the guide system.

In order to overcome the above drawbacks and achieve the pre-set purposes, the invention proposes provision of equipment according to claim 1.

BRIEF DESCRIPTION OF THE DRAWINGS

The equipment according to the invention will now be described with reference to the attached plates of drawings, in which.

DETAILED DESCRIPTION

Figure 1:
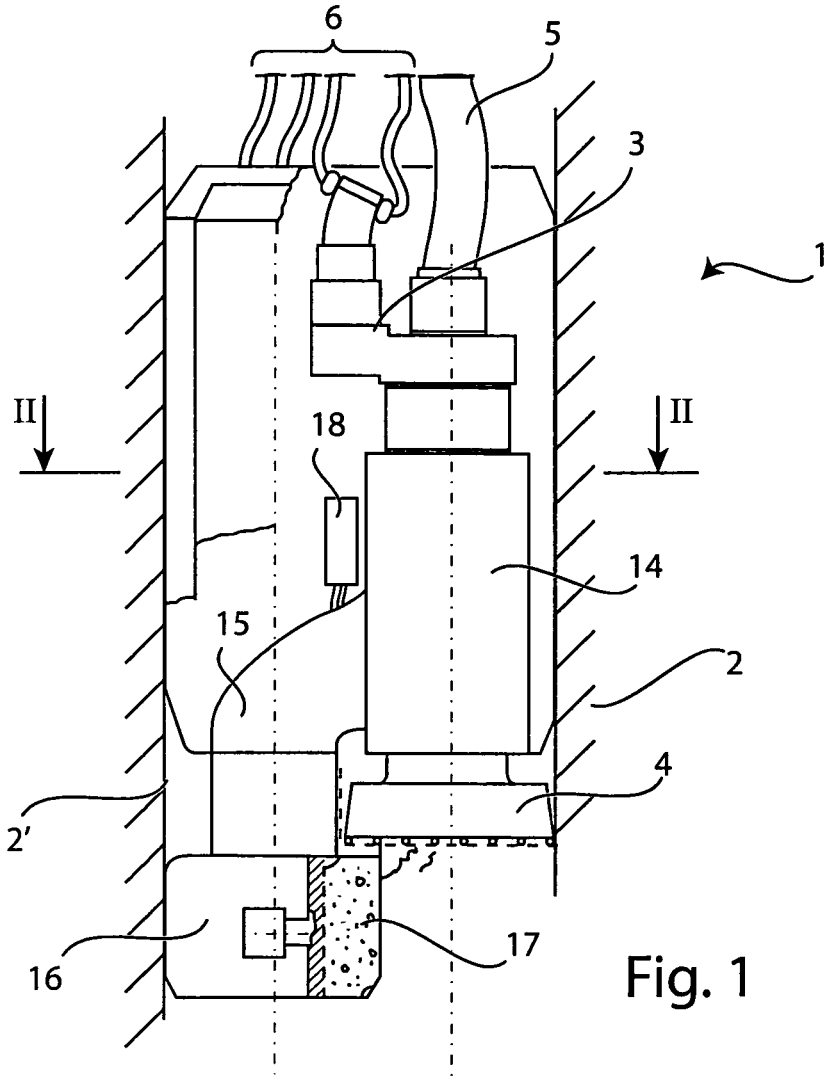
FIG. 1 shows the equipment according to the invention in a partial longitudinal section.
Figure 2:
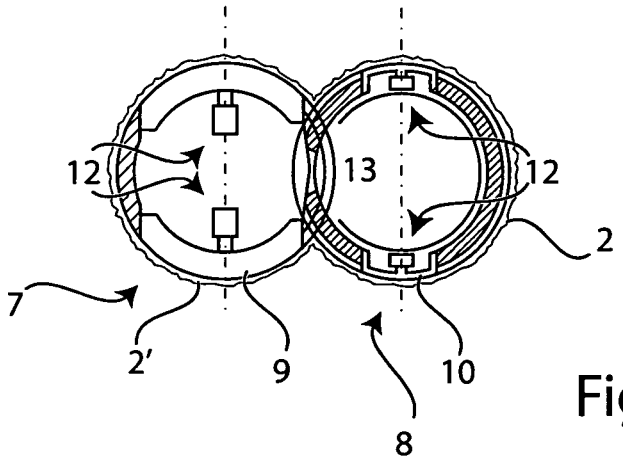
FIG. 2 shows the equipment according to the invention in the section II-II of FIG. 1.

The solution of the invention consists, in a non-limiting embodiment provided by way of example, of excavating equipment 1, which is supported in the hole 2 being made by known hoisting means (not illustrated) and comprises a motor 3 for turning the bit 4. The hole can be at least in part filled with a drilling fluid, and the system for clearing out the debris uses a reverse-circulation process so that the drilling debris is conveyed onto the surface through a flexible tubing 5 wound onto a purposely provided winder. Manoeuvred in the same way are the pipes and the electrical cables 6 necessary for actuation and control of the unit, including the measurements and corrections regarding its position performed with known means.

The machines that manoeuvre lowering of the equipment into the excavation as likewise the systems for winding flexible pipes and electrical cables for measurements and controls are of a type known, for example, in the sector of hydromills.

The guide system is constituted by two cylindrical bodies 7 and 8 fixed with respect to one another, which occupy a hole 2' that has been previously completed and the hole 2 currently being made. Each body 7 and 8 comprises expandable surfaces 9 and 10, which eliminate any play present in current equipment, coming into contact and pushing against the walls of the two holes.

The expandable surfaces 9 of the body 7 are, in this example, opposed to one another. The system can be equipped with pistons 12 for expanding and retracting the expandable surfaces 9. The expandable surfaces 10 of the other body 8 are, once again in this example, also opposed to one another. Other pistons 13 can be provided for expanding and retracting the expandable surfaces 10.

The bit 4, in the embodiment illustrated, is carried by a hole-bottom hammer 14 contained inside the body 8 that slides into the hole 2 being made. The drilling means, however, could also be a normal bit for rotation drilling.

Formation and falling of large-sized debris into the previous hole 2' underneath the bit 4 is hindered and limited by an extension or head 16 of the guide, which extends underneath the bit 4 and occupies the entire diameter of the hole. Said extension 16 is connected through an arm 15 to the excavation device in such a way as to advance therewith and is provided with expandable surfaces 17 for supporting the soil underlying the bit 4.

The head 16 and the block 17 fill the hole 2' already made completely in order to provide a support against any caving of the area being demolished.

The expandable surface 17, after use, can be brought outside the excavation area, or else can be of the sort that can be dismantled or else of the disposable type.

The excavating system, constituted by the motor 3, the hammer 14, the bit 4, the head 16, and the block 17, is only subject to its own weight and is able to slide for a certain stretch with respect to the guides to perform a step-by-step advance according to the axis of the borehole. At intervals, the guides are to be disengaged from the walls and allowed to drop down following the excavation device.

The steps of advance referred to above of the excavation devices 4 and 14 with respect to the guide devices 7 and 8 can alternatively be governed by controlled members, such as, for example, hydraulic cylinders 18. In this case, it is possible to apply to the bit also the forces of thrust, which add to the weight.

At the end of the drilling operation, in order to prevent a progressive difference in level between the bottoms of the various holes, the extension, partially constituted by material that can be drilled (e.g., concrete) is released from the excavating system, which advances until it demolishes down the necessary depth.

Alternatively, the expandable surfaces of the extension are retractable until they remains outside the area to be excavated, or else the entire extension can be easily disassembled in order to perform the last part of the digging operation.

The invention claimed is:

1. Equipment for drilling secant holes comprising:

a bit included in an excavating system, inserted in a hole being drilled and a guide system, both of which are set in the hole and a previously made hole, the two systems being fixed with respect to one another in such a way as to define a pre-set distance between centers of the holes;

the guide system being provided with first expandable surfaces that can be pushed against the walls of the previously made hole to obtain centering without play and an anchorage in a fixed position, and with second expandable surfaces that can be pushed against the walls of the hole to obtain centering without play and an anchorage in a fixed position.

2. The equipment for drilling secant holes according to claim 1, wherein the equipment is hung and maneuvered by hoisting means.

3. The equipment according to claim 1, wherein the hole being made is filled with a drilling fluid, and the system for clearing out the debris uses reverse circulation.

4. The equipment according to claim 3, wherein the debris produced by the bit is cleared out of the drilling fluid through a flexible pipe that can be wound up.

5. The equipment according to claim 1, wherein the excavating system slides along the axis of the hole being made with respect to guides, anchored to walls of the hole.

6. The equipment according to claim 5, wherein sliding is obtained with purposely provided actuation means.

7. The equipment according to claim 1, wherein the auxiliary digging movements expansion of the guide and centering retractable surfaces and advance of the excavating assembly with respect to the guide, are actuated by flexible pipes that can be wound up.

8. The equipment according to claim 1, wherein the excavating system comprises a drilling system having a hole-bottom hammer.

9. The equipment according to claim 1, wherein the expandable surfaces make corrections in the direction of the excavation.

10. The equipment according to claim 1, wherein the excavating system comprises at least one pipe for clearing out the debris from the previous holes.

11. The equipment according to claim 1, further comprising rotation means connected to the bit and completely introduced into the hole.

12. The equipment according to claim 11, wherein the rotation means comprises at least one motor supplied through flexible pipes or cables that can be wound up.

13. The equipment according to claim 12, further comprising a motor above the equipment for driving rotation for drilling.

14. The equipment according to claim 11, wherein the excavating system is equipped with a retractable extension set in the previous hole.

15. The equipment according to claim 14, wherein the extension is slid by hydraulic cylinders.

16. The equipment according to claim 11, wherein the excavating system is equipped with an extension set in the previous hole, the extension being slidable with respect to the guides.

17. The equipment according to claim 16, wherein the extension is slid by hydraulic cylinders.

18. The equipment according to claim 11, wherein the extension or head is provided with cable for actuating and controlling the equipment, for measurements and corrections.

19. The equipment according to claim 1, wherein the expandable surfaces are equipped with a piston for expanding or retracting the expandable surfaces.

20. The equipment according to claim 1, wherein the guide system is provided with cable for actuating and controlling the equipment, for measurements and corrections.

21. The equipment according to claim 1, further comprising a motor above the equipment for driving rotation for drilling.

22. Equipment for drilling secant holes comprising: an excavating system inserted in a hole being drilled and a guide system, both of which are set in the hole and a previously made hole, the two systems being fixed with respect to one another in such a way as to define a pre-set distance between centers of the holes; wherein the excavating system comprises rotation means and a bit connected thereto, and is completely introduced into the hole; wherein the excavating system is equipped with an extension set in the previous hole underneath the bit and is designed to support the area being demolished against caving-in.

23. The equipment according to claim 22, wherein the extension is provided with an expandable surface, which supports the wall underneath the bit and can be brought out of the area of excavation, or can be disassembled or is disposable.

24. The equipment according to claim 22, wherein the extension is retractable.

25. The equipment according to claim 22, wherein the extension is slidable with respect to the guides.

26. The equipment according to claim 22, wherein the extension or head is provided with cable for actuating and controlling the equipment, for measurements and corrections.

* * * * *